US005397130A

United States Patent [19]

Brown

[11] Patent Number: 5,397,130

[45] **Date of Patent: * Mar. 14, 1995**

[54] PORTABLE FLAG-TARGET FOR FLYING-DISC GAME AND METHOD OF MANUFACTURE THEREFOR

[76] Inventor: David C. Brown, 11020 N. 74th St., Scottsdale, Ariz. 85062

[ * ] Notice: The portion of the term of this patent subsequent to Apr. 19, 2011 has been disclaimed.

[21] Appl. No.: 225,008

[22] Filed: Apr. 8, 1994

Related U.S. Application Data

[63] Continuation of Ser. No. 81,114, Jun. 25, 1993, Pat. No. 5,303,931.

[51] Int. Cl.[6] ..... A63B 67/06; F41J 1/00; G09F 17/00; B21D 53/00

[52] U.S. Cl. ..... 273/348; 273/34 R; 29/412; 29/416; 29/525.1; 116/173

[58] Field of Search ..... 29/412, 415, 416, 451, 29/460; 273/34 R, 176 B, 181 B, 181 R, 348, 378; 116/173, 174, 175; 52/720; 446/46; D11/166, 181; 248/530

[56] References Cited

U.S. PATENT DOCUMENTS

| | | | |
|---|---|---|---|
| 4,039,189 | 8/1977 | Headrick et al. | 273/105 |
| 4,792,143 | 12/1988 | Headrick | 273/400 |
| 4,809,988 | 3/1989 | Hunter | 273/400 |
| 4,949,979 | 8/1991 | Wheatcroft | 273/389 |

*Primary Examiner*—Tom Hughes
*Attorney, Agent, or Firm*—Antonio R. Durando; Harry M. Weiss

[57] ABSTRACT

A method of manufacturing a two-section flag pole comprising a pointed lower section for planting into the ground and an upper section having a colored area and a numbered flag for establishing a target in a game of flying-disc golf. Each flag may be removed from or rolled over the pole and the pole can be disassembled for ease of storage. A threaded or snap-on quick-coupler is used to assemble the two sections of each pole, so that it may be easily and quickly installed at each selected target site. The flag poles can be manufactured entirely by utilizing standard-size tubing available for gardening applications.

20 Claims, 1 Drawing Sheet

PORTABLE FLAG-TARGET FOR FLYING-DISC GAME AND METHOD OF MANUFACTURE THEREFOR

RELATED APPLICATIONS

This is a continuation application of U.S. Ser. No. 08/081,114, filed on Jun. 25, 1993, and scheduled to issue on Apr. 19, 1994, as U.S. Pat. No. 5,303,931.

BACKGROUND OF THE INVENTION

1. Field of the Invention

This invention is related in general to games involving the throwing of flying discs or similar objects in an attempt to strike a target. In particular, the invention provides a novel, portable flag-pole device for setting up a game in an open field and an economical method for manufacturing the same.

2. Description of the Prior Art

Many games exist that are based on the idea of providing a target placed at a distance from a starting point from where players have to move an object until the target is reached. The game of golf is such a game wherein the target consists of a cup and the object is a golf ball.

Another popular game consists of throwing a flying disc, such as the well known toy sold under the trademark "Frisbee," in the direction of a receiver or toward a predetermined target. The object of the game is either to catch the disc in flight or to land it on the intended target, thus scoring points according to predetermined game rules.

Several patents cover devices used to play these kinds of games. For example, U.S. Pat. No. 4,039,189, issued to Headrick et al. (1977), describes a flying disc entrapment device comprising a post mounted perpendicularly in the ground and a plurality of chains attached to the protruding end of the post and extending downwardly into an upwardly open basket mounted on the post. When a flying disc hits the chains, the forward motion is arrested, causing the disc to drop into the basket. Placing a number of these devices strategically around a playing field enables a kind of flying disc golf game to be played.

Headrick refined this device in his U.S. Pat. No. 4,792,143 (1988) with a new arrangement of the chains. In the later patent, he taught a circular support bracket mounted on the upper end of the pole with a plurality of outside and inside chains mounted on the bracket. The outside chains extend downwardly and inwardly and are attached to a loose ring surrounding the pole and within the basket. The inside chains extend downwardly and straight or outwardly and are attached to a larger loose ring.

The arrangement provide a dense ring of intersecting chains that entangle and stop flying discs moving at a wider variety of speeds and angles.

In U.S. Pat. No. 4,809,988 (1989), Hunter describes a device for a goal that traps objects, such as balls, propelled at the goal; the trapping is accomplished by suspended members, netting, or draped ropes or chains attached to a frame.

Another kind of device to trap flying discs is taught by U.S. Pat. No. 4,949,979, issued to Wheatcroft (1990). The apparatus comprises a frame supported and elevated by legs and to which is secured a conical shaped net and a pivotally secured target. A flying disc that hits the target causes the target to pivot toward the net so that the disc falls into and is trapped by the net.

These patents describe rather cumbersome apparatus for carrying around and setting up in an open field, especially if multiple targets are intended to be installed along a multiple-leg course. While the feature that enables a target to catch and retain a flying object may be desirable for some games, it is not necessary for a game that only measures the ability of a player to reach the target with a minimum number of throws, such that a hit may be recorded simply by visual observation. Accordingly, this invention provides a simple, portable flag designed for playing a game that requires a player to throw a flying disc toward it from a starting point and approach the flag through repeated throws, as necessary, until the disc strikes the flag. Multiple flag targets can be set up along a course in an open area, such as a park, to resemble a golf course.

BRIEF SUMMARY OF THE INVENTION

One objective of this invention is to provide a lightweight target that can be disassembled into separate sections for portability in a game kit that contains multiple targets intended to be set up in a multiple-leg course. This feature is obtained by having each target consist of a collapsible two-section pole of dimensions suitable for storage and transport in a carrying case.

Another objective of the invention is an apparatus that can be quickly and easily installed at chosen locations along the playing course. Thus, a pointed end and a quick-coupler are provided in each pole for planting into the ground and for connecting the sections of the pole.

A further goal of the invention is a target that is visible from a distance, so as to provide a clear mark for aiming and recording of scores, without being bulky and unsuitable for storage in a carrying case. Therefore, each target includes a flexible flag that can be wrapped around the pole to minimum space requirements during storage.

A final objective is the easy and economical manufacture of the device according to the above stated criteria. This is achieved by using commercially available components and materials, modified only to the extent necessary to fit the requirements of the invention.

Therefore, according to these and other objectives, the present invention consists of a two-section flag pole comprising a pointed lower section for planting into the ground and an upper section having a colored area and a numbered flag for establishing a target in a game of flying-disc golf. Each flag may be removed from or rolled over the pole and the pole can be disassembled for ease of storage. A threaded or snap-on quick-coupler is used to assemble the two sections of each pole, so that it may be easily and quickly installed at each selected target site. The flag poles can be manufactured entirely by utilizing standard-size tubing available for gardening applications.

Various other purposes and advantages of the invention will become clear from its description in the specifications that follow and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

This invention consists of the utilization of simple components available in commerce to manufacture light-weight, collapsible flag-pole targets for use in flying-disc games. The main point of the invention lies in the simple and economical method of construction.

Figure 1:
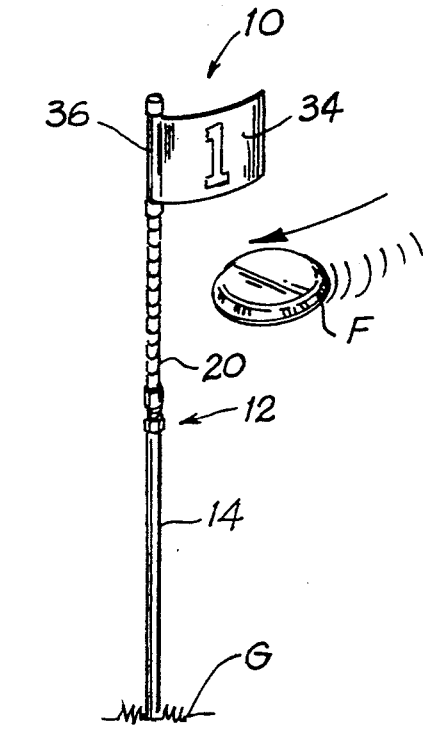
FIG. 1 is a perspective view of the preferred embodiment of the apparatus of this invention as used planted in the ground for a flying-disc golf game.
Figure 2:
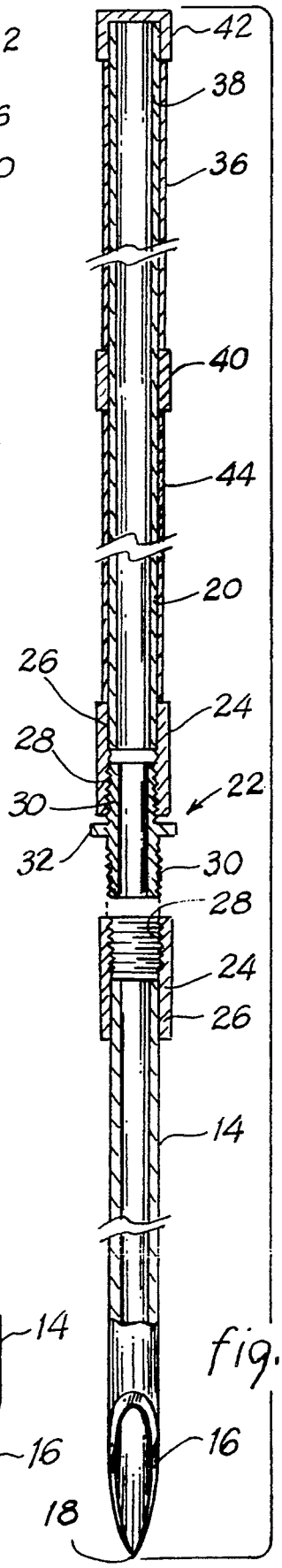
FIG. 2 is a cross-section of an elevational view of the embodiment of the flag-pole target shown in FIG. 1.
Figure 3:
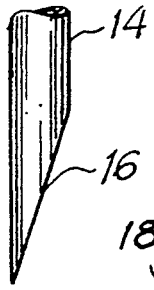
FIG. 3 is a side view of the tip of the lower portion of the flag pole of the invention.

Referring to the drawings, wherein like parts are designated throughout with like numerals and symbols, FIG. 1 illustrates the flag-pole apparatus 10 of this invention in use as a target for a flying-disc game. The device consists of a multiple-section pole 12 (illustrated in the drawings as having two sections) planted in the ground G. As seen in FIG. 2, the lower section 14 consists of a tubular member wherein the bottom portion 16 has been cut to form a pointed end 18 at the lower tip thereof. The pointed end 18 is provided as a sharp instrument to facilitate the planting of section 14 into the ground, as shown in FIG. 1, without requiring additional hardware to be incorporated into the structure of the pole. FIG. 3 illustrates the profile of the cut tubular member as would be seen from the left side of FIG. 2.

Figure 4:
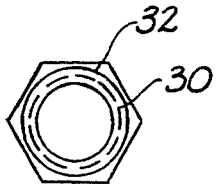
FIG. 4 is a longitudinal view of the threaded coupler shown in FIG. 2 for connecting the upper and lower section of the flag pole.

The lower section 14 of the pole is rigidly and removably connected to the upper section 20 by means of a quick coupler, shown in FIG. 2 as a threaded connector 22. In the preferred embodiment of the invention, the bottom portion of the lower section 14 and the top portion of the upper section 20 are both fitted with a cylindrical sleeve 24 having an interior smooth side 26 conforming to the outer wall of the tubular section and having an opposite, interior threaded side 28 conforming to the threaded connector 22. The side 26 is slipped over and attached to (such as by glue) the respective portions of sections 14 and 20, whereby the sleeve side 28 provides a threaded female end for each section. The connector 22 consists of a tubular segment having opposite threaded male ends 30 conforming to the interior of side 28 of the sleeves 24, thus providing a suitable threaded connector to join the lower and upper sections 14 and 20 of the flag pole. An enlarged middle section 32 of the connector 22 may be provided to facilitate the screwing and unscrewing of the sleeves 24 onto the connector 22. FIG. 4 is a view taken along the axis of an embodiment of the connector 22 consisting of a standard plumbing fitting having a hexagonal middle section 32 for use with an appropriately-sized wrench in tightening the various parts.

Figure 5:
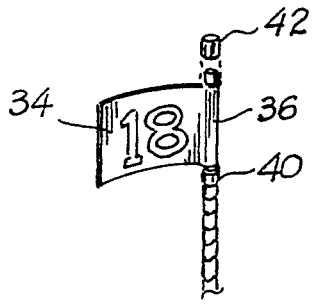
FIG. 5 is a perspective partial view of the upper section of the flag-pole of the invention illustrating the installation of a slip-mounted flag on the pole.

As shown in FIGS. 2 and 5, the top segment 38 of the upper section 20 of the pole is fitted with a flag 34 having a lateral sleeve 36 sized to permit it to be slipped over the segment 38 and mounted thereon in snug fashion. A retaining collar 40, affixed at the bottom of the segment 38, is provided to prevent the flag 34 from sliding down the pole. Similarly, a removable cap 42 is mounted on the top of the segment 38 to prevent the flag from sliding out of the pole. As illustrated in FIGS. 1 and 5, the flag 34 may carry different numbers on each side, so that it can be used at different numbered target sites.

Figure 6:
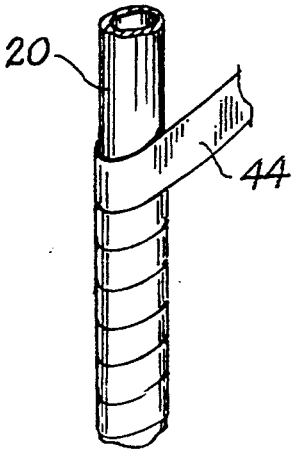
FIG. 6 is a perspective partial view of the main portion of the upper section of the flag-pole of the invention illustrating the installation of colored tape on the pole.

As also illustrated in FIG. 1, the flying-disc game for which this invention is designed requires that the disc F strike either the flag or the upper section of the pole in order to score points, as predetermined game rules may dictate. Since the game is played by throwing the disc from a distance, it is important that the chosen strike zone be visible from afar and easily distinguishable from surrounding objects. Therefore, in its preferred embodiment the invention comprises a colored zone in the upper section below the collar 40 provided by wrapping colored tape 44 around it, as illustrated in FIG. 6.

Figure 7:
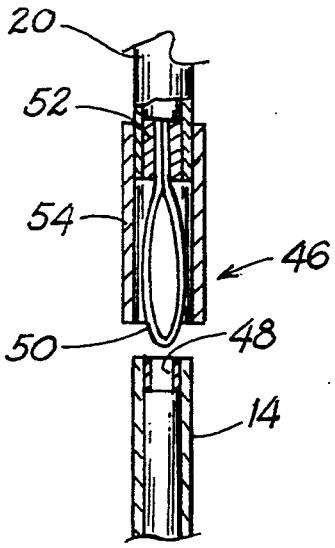
FIG. 7 is a partial cross-sectional view of an alternative snap-on coupler utilized to connect the upper and lower sections of the flag pole.

In another embodiment of the invention shown in FIG. 7, a coupler 46 of different construction is disclosed. Its configuration is designed to provide a snap-on type of connection for quick attachment and release of the upper and lower sections 20 and 14. As in the case of the prior embodiment, the coupler 46 is designed for construction utilizing components that are available in the open market, thus requiring no special manufacturing. A lower restriction insert 48, consisting of a small length of pipe having an outside diameter equal to the inside diameter of the top portion of the lower section 14, is fitted into the lower section of the pole to provide a restriction to passage therethrough. This restriction is intended to engage a spring anchor 50 attached to the bottom portion of the upper section 20 of the pole. The anchor 50 consists of a resilient wire forming an elongated and pointed elliptical shape with a minor axis greater than the inside diameter of the insert 48, so that the anchor 50 may be squeezed and pushed through the insert, whereby its expansion provides a retaining lock between the spring and the insert. The spring anchor 50 is attached longitudinally to the bottom portion of the section 20, so as to protrude downward for insertion through the lower insert 48. The anchor may be attached by pressing it into (as shown in FIG. 7) or otherwise attaching it to an upper insert 52 which is then mounted inside the bottom portion of the upper section 20. Finally, an alignment guide 54 is provided by fastening to the bottom portion of the upper section 20 a length of pipe having an inside diameter conforming to the section's outside diameter, as illustrated in the drawing. Thus, the guide 54 adds strength and stability to the assembled flag pole 12. It is noted that, inasmuch as the preferred embodiments of the invention utilize plastic components, all of these parts can be easily attached to one another by using standard glues.

I found that standard ½-inch polyvinyl chloride (PVC) tubing and standard fittings available with it for use in gardening are optimal components for manufacturing the flag-pole target of the invention. The sleeves 24 are available, for example, in hardware stores under the generic label of ½-inch threaded female adaptors; the connector 22 is known as a double-ended threaded male coupling; and the collar 40 and cap 42 as a female slip coupling and a slip cap, respectively. The inserts 48 and 52 can be made with segments of ¼-inch PVC pipe; and the guide 54 with a slip female adaptor.

Thus, a flag-pole target according to the invention is easily constructed by cutting some tubing into an upper section 20 and a lower section 14, preferably in lengths of about 35 and 39 inches, respectively. Approximately 4 inches of the bottom portion 16 of the lower section is cut to form a pointed end 18. The smooth side of a threaded sleeve 24 is slipped over and glued to the top portion of the lower section 14. A collar 40 is slipped over and glued to the upper section 20 at a distance from the top approximately equal to the height of the flag 34 used in the game (preferably 12 inches) and a cap 42 is provided to removably secure the flag in place. The smooth side of another threaded sleeve 24 is slipped over and glued to the bottom portion of the upper section 20. Finally, tape of the desired color is wrapped around the upper section to set out a strike zone for the flying disc used in the game. A flag-pole parts so constructed are easily assembled into a target for use in the field and disassembled for storage in a carrying case after a game is played.

While the embodiments shown in the figures features the specific shapes therein described, the invention can obviously take other shapes with equivalent functionality and utility. In fact, any shape for any of the components that retains the functional characteristics described above provides an acceptable apparatus to practice the invention.

Accordingly, various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

What I claim as my invention is:

1. A method for manufacturing a flag-pole target for use with a flag of a predetermined height in a flying-disc game, comprising the following steps:

(a) cutting a length of tubing to provide a lower section and an upper section of a flag pole, each of said sections having a top portion and a bottom portion;

(b) adapting the bottom portion of said lower section to provide a pointed end;

(c) providing joining means for rigidly and removably connecting the top portion of said lower section to the bottom portion of said upper section; and (d) providing retaining means for retaining a flag along the top portion of said upper section;

whereby the flag may be mounted over the top portion of said upper section and secured by said retaining means; the upper and lower sections may be removably connected by utilizing said joining means; and the flag pole so assembled may be planted into a supporting surface by inserting said pointed end therethrough.

2. The method recited in claim 1, further comprising the step of wrapping colored tape around said upper section.

3. The method recited in claim 1, wherein said tubing consists of plastic.

4. The method recited in claim 1, wherein said tubing consists of polyvinyl chloride pipe.

5. The method recited in claim 1, wherein said tubing is ½-inch polyvinyl chloride pipe cut to form an upper section approximately 35 inches long and wherein the bottom portion of said lower section is cut to form a pointed end about 4 inches long.

6. The method recited in claim 1, wherein said step of providing joining means for rigidly and removably connecting the top portion of said lower section to the bottom portion of said upper section consists of attaching a first threaded female sleeve to the top portion of said lower section; attaching a second threaded female sleeve to the bottom portion of said upper section; and providing a threaded coupler having opposite threaded male ends conforming to said first and second threaded female sleeves;

whereby the upper and lower sections may be connected by screwing said threaded coupler into said first and second threaded female sleeves.

7. The method recited in claim 6, further comprising the step of wrapping colored tape around said upper section.

8. The method recited in claim 6, wherein said tubing consists of plastic.

9. The method recited in claim 6, wherein said tubing consists of polyvinyl chloride pipe.

10. The method recited in claim 6, wherein said tubing is ½-inch polyvinyl chloride cut to form an upper section approximately 35 inches long and wherein the bottom portion of said lower section is cut to form a pointed end about 4 inches long.

11. The method recited in claim 6, further comprising the step of wrapping colored tape around said upper section; wherein said tubing consists of ½-inch polyvinyl chloride pipe; and wherein said tubing is cut to form an upper section approximately 35 inches long and wherein the bottom portion of said lower section is cut to form a pointed end about 4 inches long.

12. The method recited in claim 1, wherein said step of providing joining means for rigidly and removably connecting the top portion of said lower section to the bottom portion of said upper section consists of fitting a lower restriction insert into the top portion of said lower section; of attaching a spring anchor to the bottom portion of said upper section, said anchor consisting of a resilient wire forming an elongated and pointed elliptical shape with a minor axis greater than an inside diameter of said restriction insert, so that the anchor may be squeezed and pushed through the insert whereby a retaining lock between the anchor and the insert is provided; and of fastening an alignment guide to the bottom portion of the upper section.

13. The method recited in claim 12, wherein said restriction insert consists of a segment of pipe having an outside diameter equal to an inside diameter of said lower section.

14. The method recited in claim 12, further comprising the step of wrapping colored tape around said upper section.

15. The method recited in claim 12, wherein said tubing consists of polyvinyl chloride pipe.

16. The method recited in claim 12, wherein said tubing is ½-inch polyvinyl chloride cut to form an upper section approximately 35 inches long and wherein the bottom portion of said lower section is cut to form a pointed end about 4 inches long.

17. The method recited in claim 12, further comprising the step of wrapping colored tape around said upper section; wherein said tubing consists of ½-inch polyvinyl chloride pipe; and wherein said tubing is cut to form an upper section approximately 35 inches long and wherein the bottom portion of said lower section is cut to form a pointed end about 4 inches long.

18. A flag-pole target manufactured according to the process of claim 1.

19. A flag-pole target manufactured according to the process of claim 6.

20. A flag-pole target manufactured according to the process of claim 12.

* * * * *

US005397130C1

(12) REEXAMINATION CERTIFICATE (4735th)

United States Patent

Brown

(10) Number: US 5,397,130 C1

(45) Certificate Issued: Feb. 18, 2003

(54) PORTABLE FLAG-TARGET FOR FLYING-DISC GAME AND METHOD OF MANUFACTURE THEREFOR

(75) Inventor: David C. Brown, 11020 N. 74th St., Scottsdale, AZ (US) 85062

(73) Assignee: David C. Brown, Tempe, AZ (US)

Reexamination Request:
No. 90/006,071, Jul. 26, 2001

Reexamination Certificate for:

| | |
|---|---|
| Patent No.: | **5,397,130** |
| Issued: | **Mar. 14, 1995** |
| Appl. No.: | **08/225,008** |
| Filed: | **Apr. 8, 1994** |

( * ) Notice: This patent is subject to a terminal disclaimer.

Related U.S. Application Data

(63) Continuation of application No. 08/081,114, filed on Jun. 25, 1993, now Pat. No. 5,303,931.

(51) Int. Cl.[7] ..... A63B 67/06; F41J 1/00; G09F 17/00; B21D 53/00

(52) U.S. Cl. ..... 273/348; 29/412; 29/416; 29/525.1; 116/173

(58) Field of Search ..... 273/348, 400, 273/336; 473/176, 475; 403/296, 297; 52/736.4, 726.3; 116/173–175; 446/46

(56) References Cited

U.S. PATENT DOCUMENTS

| | | | | | |
|---|---|---|---|---|---|
| 1,631,566 | A | * | 6/1927 | Walton | 116/173 |
| 2,708,779 | A | * | 5/1955 | Tiger | 403/297 |
| 3,368,271 | A | * | 2/1968 | Scheffler | 273/DIG. 7 |
| 3,717,343 | A | * | 2/1973 | Hartford | 273/30 |
| 4,386,779 | A | | 6/1983 | Whitlock | 273/336 |
| 4,407,505 | A | * | 10/1983 | Kendziorski | 116/173 |
| 5,125,760 | A | * | 6/1992 | Challis | 403/296 |

* cited by examiner

*Primary Examiner*—Mark S. Graham

(57) ABSTRACT

A method of manufacturing a two-section flag pole comprising a pointed lower section for planting into the ground and an upper section having a colored area and a numbered flag for establishing a target in a game of flying-disc golf. Each flag may be removed from or rolled over the pole and the pole can be disassembled for ease of storage. A threaded or snap-on quick-coupler is used to assemble the two sections of each pole, so that it may be easily and quickly installed at each selected target site. The flag poles can be manufactured entirely by utilizing standard-size tubing available for gardening applications.

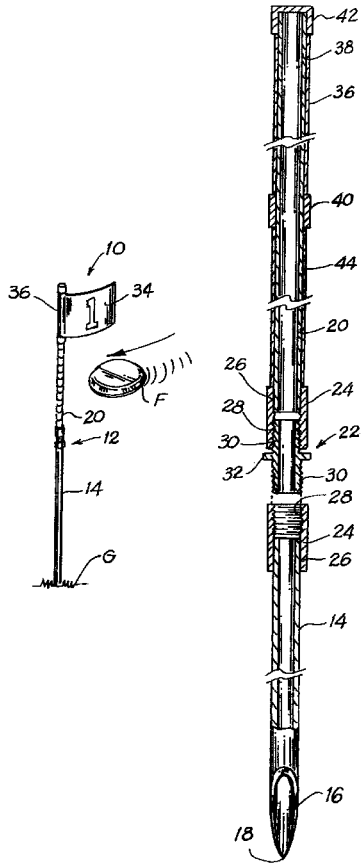

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–20 are cancelled.

* * * * *